US011688955B2

(12) United States Patent
Balmer

(10) Patent No.: US 11,688,955 B2
(45) Date of Patent: Jun. 27, 2023

(54) FASTENING KIT

(71) Applicant: ETA SA Manufacture Horlogère Suisse, Grenchen (CH)

(72) Inventor: Raphaël Balmer, Vicques (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 34 days.

(21) Appl. No.: 17/242,368

(22) Filed: Apr. 28, 2021

(65) Prior Publication Data

US 2021/0359431 A1 Nov. 18, 2021

(30) Foreign Application Priority Data

May 13, 2020 (EP) ..... 20174503

(51) Int. Cl.

| | |
|---|---|
| ***G04B 27/00*** | (2006.01) |
| ***H01R 4/48*** | (2006.01) |
| ***H01R 43/027*** | (2006.01) |
| *G04G 17/06* | (2006.01) |

(52) U.S. Cl.

CPC ..... *H01R 4/48* (2013.01); *H01R 43/027* (2013.01); *G04B 27/00* (2013.01); *G04G 17/06* (2013.01)

(58) Field of Classification Search

CPC . G04C 9/00; G04C 9/06; G04C 3/001; G04B 27/00; G04B 27/004; G04B 27/02

See application file for complete search history.

(56) References Cited

U.S. PATENT DOCUMENTS

| | | | | |
|---|---|---|---|---|
| 4,247,931 | A | 1/1981 | Ogihara et al. | |
| 4,351,040 | A * | 9/1982 | Aoki | G04C 3/008 968/452 |
| 4,519,287 | A | 5/1985 | Naruse | |
| 4,910,721 | A * | 3/1990 | Hayakawa | G04C 9/00 368/149 |
| 5,016,231 | A * | 5/1991 | Kawaguchi | G04C 9/00 368/80 |
| 9,671,758 | B2 * | 6/2017 | Wu | G04B 27/004 |
| 2007/0247978 | A1 | 10/2007 | Carrard et al. | |
| 2015/0355602 | A1 | 12/2015 | Wu | |

FOREIGN PATENT DOCUMENTS

| | | | |
|---|---|---|---|
| CA | 546675 | A | 9/1957 |
| CN | 101063869 | A | 10/2007 |
| CN | 101840196 | A | 9/2010 |
| CN | 203308878 | U | 11/2013 |
| CN | 107193198 | A | 9/2017 |
| EP | 1 857 892 | A1 | 11/2007 |
| FR | 2 394 839 | A1 | 1/1979 |

(Continued)

OTHER PUBLICATIONS

European Search Report dated Nov. 9, 2020 in European Application 20174503.1 filed on May 13, 2020, 3 pages (with English Translation of Categories of Cited Documents).

(Continued)

*Primary Examiner* — Phuong Chi Thi Nguyen

(74) *Attorney, Agent, or Firm* — Oblon, McClelland, Maier & Neustadt, L.L.P.

(57) ABSTRACT

A fastening kit for a watch including at least one fastening device for fastening, according to a fastening method, at least one tube and for electrically connecting the at least one tube to a support.

13 Claims, 2 Drawing Sheets

(56) References Cited

FOREIGN PATENT DOCUMENTS

| | | | |
|---|---|---|---|
| JP | 58-020946 | Y2 | 5/1983 |
| JP | 8-502875 | A | 3/1996 |
| JP | 2000-110820 | A | 4/2000 |
| JP | 2000-175403 | A | 6/2000 |
| JP | 2019-70643 | A | 5/2019 |
| KR | 10-2052802 | B1 | 12/2019 |
| RU | 2010 109 850 | A | 9/2011 |
| WO | WO 2020/057943 | A1 | 3/2020 |

OTHER PUBLICATIONS

Combined Chinese Office Action and Search Report dated Nov. 11, 2022 in Chinese Patent Application No. 202110522683.7, 5 pages.
Combined Chinese Office Action and Search Report dated May 11, 2022, in corresponding Chinese Patent Application No. 202110522683.7 (with English Translation of Category of Cited Documents), 9 pages.
Notice of Ground for Rejection dated Apr. 13, 2023, in Korean Patent Application No. 10-2021-0059439 filed on May 7, 2021, with English translation. (7 pages).

* cited by examiner

FASTENING KIT

CROSS-REFERENCE TO RELATED APPLICATION

This application claims priority to European Patent Application No. 20174503.1 filed on May 13, 2020, the entire disclosure of which is hereby incorporated herein by reference.

TECHNICAL FIELD

The present invention relates to watches and more particularly quartz watches.

TECHNOLOGICAL BACKGROUND

In some watches comprising hands, it is essential that an electrical contact is established. However, this electrical contact may be present at the beginning of the life of the watch, but it ends up by deteriorating until disappearing.

Indeed, this electrical contact is established during the assembling of various parts and in particular during a motor module: firstly, a metal element is driven on a support, then an electronic board comprising a sensor, for example, is assembled with said electrical element before the assembly is fastened to said support. Said metal element is connected to said electronic board and particularly to said mass of said electronic board by means of a metallised zone in order to enable the passage of a signal.

Except that, as mentioned above, numerous problems appear either during the assembling, such as for example the accumulation of tolerances of the various elements, which makes the fastening of these elements less and less effective and allows a gap to appear when the tolerances are lower than the average or, in contrast, when the tolerances are higher than the average, the fastening is too significant up to deteriorating all or part of the assembly and also allows a gap to appear because said electronic board may have been split.

SUMMARY OF THE INVENTION

The present invention proposes to resolve all or part of the above-mentioned drawbacks by means of a fastening device for fastening at least one tube, preferably at least one pipe and for electrically connecting said at least one tube, preferably said at least one pipe, to at least one support; said fastening device comprising at least:

- one admission zone; said at least one admission zone being configured to admit said at least one tube, preferably said at least one pipe;
- one fastening zone; said at least one fastening zone being configured to fasten said at least one tube, preferably said at least one pipe, to said at least one support; and,
- one electrical conductor; said at least one electrical conductor being configured to electrically connect said at least one tube, preferably said at least one pipe, to said at least one support.

According to one embodiment, said fastening device is a key.

According to one embodiment, said fastening device is said at least one electrical conductor.

Thanks to this disposition, said fastening device makes it possible to fasten said at least one tube, preferably said at least one pipe, to at least one support while minimising the axial clearance between said at least one tube, preferably said at least one pipe, and said at least one support and by ensuring a permanent electrical axial contact between said at least one tube, preferably said at least one pipe, and said at least one support.

According to one embodiment, said at least one admission zone and said at least one fastening zone are coplanar.

Thanks to this disposition, it is possible to admit said at least one tube, preferably said at least one pipe, into said at least one admission zone and to fasten it in said at least one fastening zone or via said at least one fastening zone by moving said fastening device parallel to the plane formed by said at least one admission zone and said at least one fastening zone.

According to one embodiment, said at least one fastening zone being configured to pin said at least one tube, preferably said at least one pipe, to said at least one support.

Thanks to this disposition, said fastening device makes it possible to minimise the gap between said at least one tube, preferably said at least one pipe, and said at least one support and to ensure an electrical contact between said at least one tube, preferably said at least one pipe, and said at least one support.

According to one embodiment, said at least one fastening zone is elastically deformable or is less elastically deformable than said at least one admission zone.

Thanks to this disposition, said at least one fastening zone may deform in order to fasten said at least one tube, preferably said at least one pipe, to said at least one support by exerting a force on said at least one tube, preferably said at least one pipe.

According to one embodiment, said fastening device comprises at least one stabilising member configured to stabilise said fastening device, preferably to stabilise said fastening device when said at least one fastening zone fastens said at least one tube, preferably said at least one pipe, to said at least one support.

According to one embodiment, said at least one stabilising member protrudes with said fastening device.

According to one embodiment, said at least one stabilising member delimits said at least one admission zone and/or said at least one fastening zone.

Thanks to one or other of these preceding dispositions, said at least one stabilising member makes it possible to stabilise and/or to minimise the gap between said at least one tube, preferably said at least one pipe, and said at least one support and to ensure an electrical contact between said at least one tube, preferably said at least one pipe, and said at least one support.

According to one embodiment, said fastening device comprises at least one securing member configured to secure said fastening device to said at least one support, preferably to secure said fastening device when said at least one fastening zone fastens said at least one tube, preferably said at least one pipe, to said at least one support.

According to one embodiment, said at least one securing member protrudes with said fastening device.

According to one embodiment, said at least one securing member is a catch.

According to one embodiment, said at least one securing member protrudes in relation to the plane of said at least one admission zone and/or of said at least one fastening zone.

According to one embodiment, said at least one securing member is coplanar with said at least one admission zone and/or said at least one fastening zone.

Thanks to one or other of these preceding dispositions, said at least one securing member makes it possible to secure said fastening device to said at least one support by limiting the movements of said fastening device and to guarantee the fastening of said at least one tube, preferably said at least one pipe, to said at least one support.

According to one embodiment, said at least one stabilising member and/or said at least one securing member is or are said at least one electrical conductor.

Thanks to this disposition, the electrical contact is performed by said at least one stabilising member and/or said at least one securing member.

The present invention relates to a tube, preferably pipe, comprising at least one groove configured to cooperate with said at least one fastening zone of said fastening device according to the invention.

Thanks to this disposition, it is possible to admit said at least one tube, preferably said at least one pipe, into said at least one admission zone and to insert said at least one groove into said at least one fastening zone so as to fasten said at least one tube, preferably said at least one pipe, to said at least one support.

The present invention relates to a support comprising at least one electrically conductive surface configured to be electrically connected to said tube, preferably to said pipe, according to the invention by means of said at least one electrical conductor of said fastening device according to the invention.

Thanks to this disposition, said at least one support ensures an electrical contact with said at least one tube, preferably said at least one pipe, by means of said fastening device.

According to one embodiment, said support comprises a securing zone configured to cooperate with said at least one securing member of said fastening device.

According to one embodiment, said securing zone is a notch.

Thanks to one or other of these preceding dispositions, said fastening device may be locked in radial position.

The present invention relates to a fastening kit comprising at least:

At least one fastening device according to the invention;

At least one tube, preferably at least one pipe, according to the invention; and, At least one support according to the invention.

Thanks to this disposition, said fastening device makes it possible to fasten said at least one tube, preferably said at least one pipe, to at least one support while minimising the gap between said at least one tube, preferably said at least one pipe, and said at least one support and by ensuring an electrical contact between said at least one tube, preferably said at least one pipe, and said at least one support.

The present invention relates to a fastening method for fastening and for electrically connecting at least one tube, preferably at least one pipe, according to the invention to at least one support according to the invention by means of at least one fastening device according to the invention; said fastening method comprising at least one:

admitting said at least one tube, preferably said at least one pipe, into said at least one admission zone of said at least one fastening device;

moving said at least one fastening device so that said at least one tube, preferably said at least one pipe, from said at least one admission zone to said at least one fastening zone;

inserting said at least one tube, preferably said at least one pipe, into said at least one fastening zone;

fastening said at least one tube, preferably said at least one pipe, to said at least one support; and, electrically connecting said at least one tube, preferably said at least one pipe, to said at least one support.

Thanks to this disposition, said fastening method makes it possible to fasten said at least one tube, preferably said at least one pipe, to at least one support while minimising the axial clearance between said at least one tube, preferably said at least one pipe, and said at least one support and by ensuring a permanent electrical axial contact between said at least one tube, preferably said at least one pipe, and said at least one support.

According to one embodiment, said fastening method according to the preceding claim, which comprising at least one step of securing to said at least one support.

Thanks to this disposition, said at least one support is secured.

According to one embodiment, said at least one step of admitting, moving, inserting, fastening, connecting and/or securing are performed successively and/or simultaneously.

Thanks to this disposition, said fastening device fastens said at least one tube, preferably said at least one pipe, to at least one support easily.

BRIEF DESCRIPTION OF THE FIGURES

The invention will be described hereafter in more detail using the appended drawings, given by way of non-limiting examples, wherein.

DETAILED DESCRIPTION OF THE INVENTION

Figure 1:
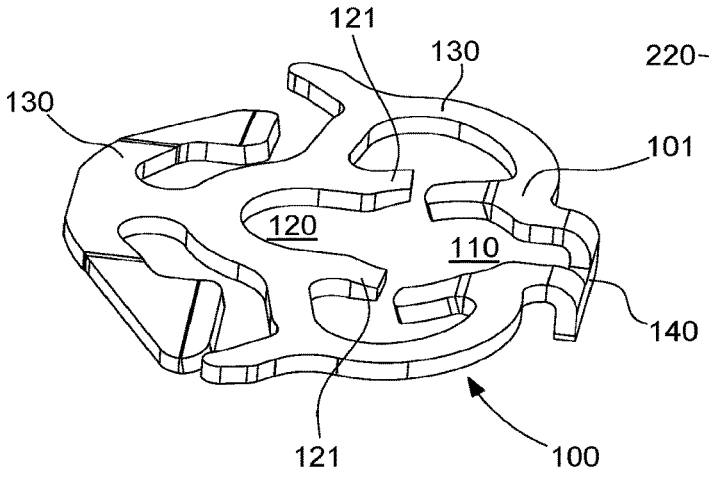
FIG. 1 illustrates at least one fastening device 100 according to one embodiment.

In some watches comprising hands, an electrical contact is sufficient or an electrical connection is sufficient for the correct operation of said watch. Although some failures may be detected during the assembling or during a very strict quality control according to the standards of the applicant, unfortunately these failures, despite being rare, may appear during the life of the product and may be detrimental to its longevity.

This electrical contact is established during the assembling of various parts and in particular during a motor module for example.

To this end, the applicant proposes a fastening device 100 for fastening at least one tube 200, preferably at least one pipe 200 and for electrically connecting said at least one tube 200, preferably said at least one pipe 200, to at least one support 300 that may take the form of an electronic board 300 or of an electronic module 300.

According to one aspect of the invention, the applicant proposes a fastening kit 400 grouping these various components, namely, said at least one fastening device 100 as previously mentioned, said at least one tube 200, preferably said at least one pipe 200, and said at least one support 300 so that said fastening device 100 may fasten said at least one tube 200, preferably said at least one pipe 200, to at least one support 300 while minimising the gap between said at least one tube 200, preferably said at least one pipe 200, and said at least one support 300 and by ensuring an electrical contact between said at least one tube 200, preferably said at least one pipe 200, and said at least one support 300.

Figure 3:
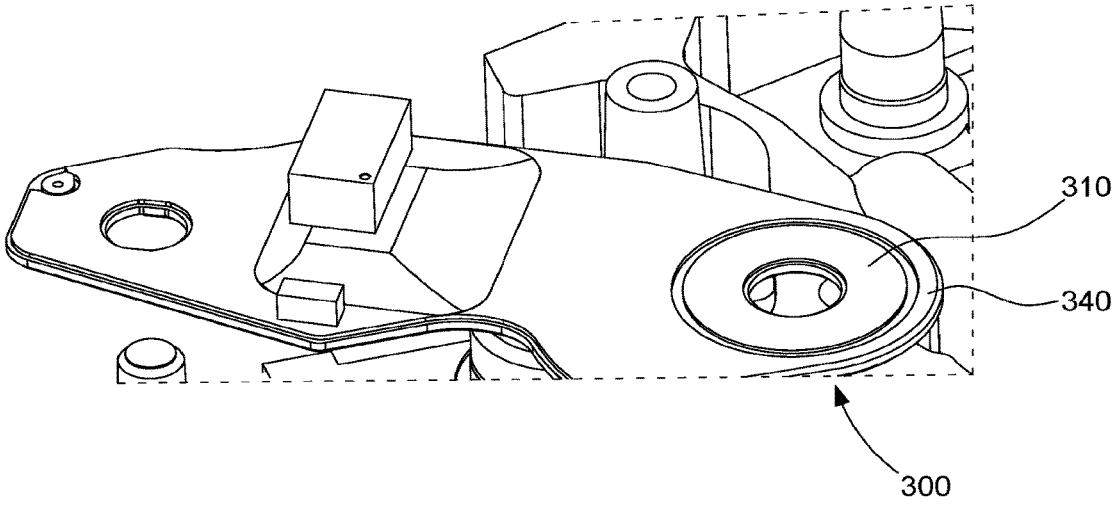
FIG. 3 discloses at least one support 300 according to one embodiment; and, FIGS. 4A-4C present a fastening method 500 for fastening and for electrically connecting said at least one tube 200, preferably said at least one pipe 200, to said at least one support 300 by means of said at least one fastening device 100 according to one embodiment.

The latter, illustrated in FIG. 3, comprises at least one electrically conductive surface 310 configured to be electrically connected to said tube 200, preferably to said pipe 200, by means of said at least one electrical conductor 101 of said fastening device 100.

Said fastening device 100, which may be, according to one embodiment shown in FIG. 1, a key 100, comprising at least one admission zone 110, at least one fastening zone 120 and at least one electrical conductor 101.

Said fastening device 100 may fasten, according to a fastening method 500 of which the steps may take place successively and/or simultaneously, said at least one tube 200, preferably at least one pipe 200, to said at least one support 300. According to the needs of the user, it may be that they choose to deposit said to said at least one support 300 on a frame 999. Said frame 999 comprises a hole wherein said at least one tube 200, preferably at least one pipe 200, is placed so as to pass through said frame 999 and said to said at least one support 300, which also comprises an opening. Preferably and in most of the embodiments, said at least one tube 200, preferably at least one pipe 200, comprises at least one bearing member 240, able to take the form of a collar, configured to give to said at least one tube 200, preferably to said at least one pipe 200, a greater stability.

Figure 4A:
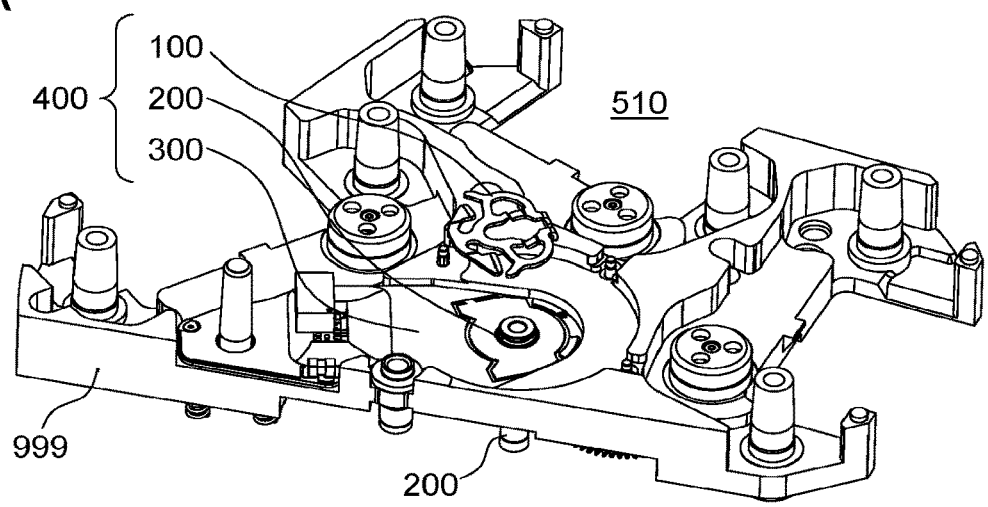

For this, said at least one tube 200, preferably of said at least one pipe 200 is admitted 510 into said at least one admission zone 110 of said at least one fastening device 100, as shown in FIG. 4A.

Figure 4B:
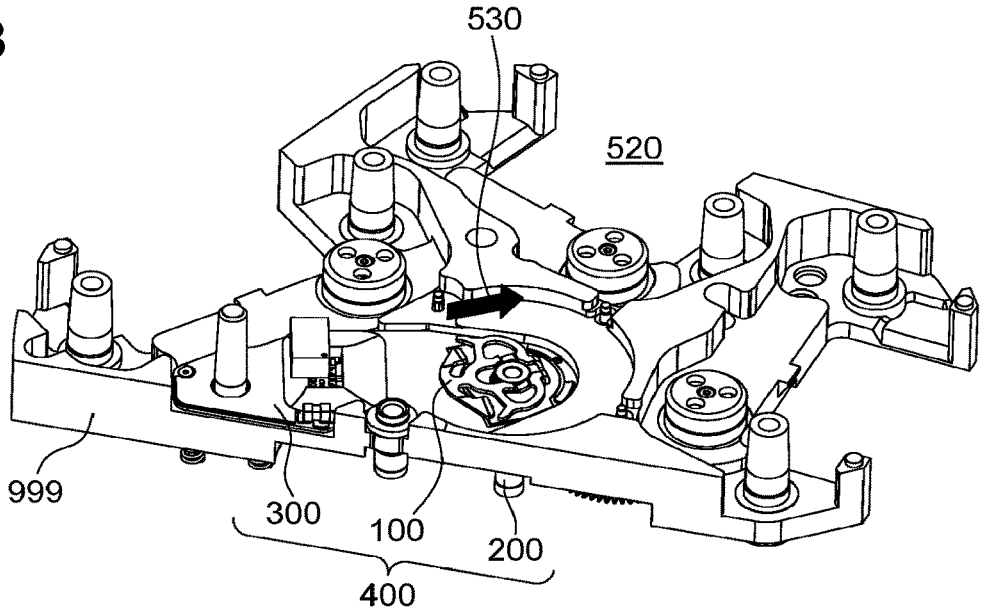

After its admission 510, FIG. 4B, said at least one fastening device 100 is moved 520 so that said at least one tube 200, preferably said at least one pipe 200, passes from said at least one admission zone 110 to said at least one fastening zone 120.

Indeed, according to one embodiment, said at least one admission zone 110 and said at least one fastening zone 120 are coplanar, so that it is possible to admit 510 said at least one tube 200, preferably said at least one pipe 200, into said at least one admission zone 110 and to move 520 said at least one fastening device 100 in said at least one fastening zone 120 parallel to the plane formed by said at least one admission zone 110 and said at least one fastening zone 120.

Figure 2:
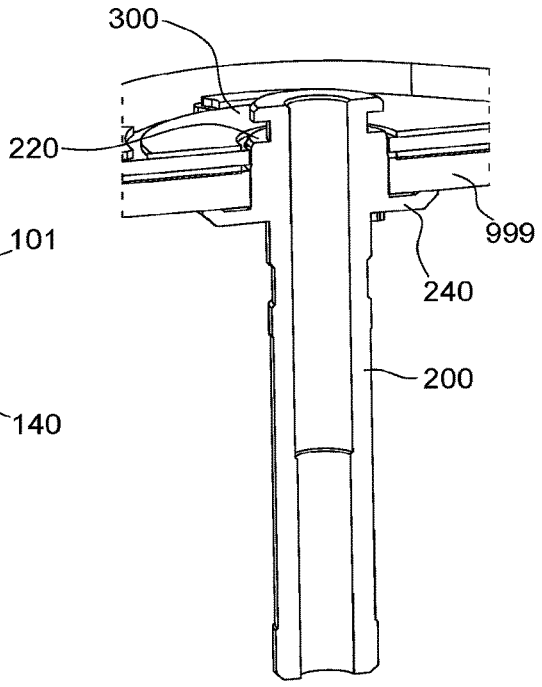
FIG. 2 shows at least one tube 200, preferably said at least one pipe 200, according to one embodiment.

Said at least one tube 200 is inserted 530, preferably of said at least one pipe 200 is inserted 530, into said at least one fastening zone 120. Said at least one fastening zone 120 may be entirely or partly delimited by at least one retention member 121 configured to be inserted into at least one groove 220, visible in FIG. 2, and to retain said at least one tube 200, preferably at least one pipe 200. In the embodiment presented in FIG. 1, said at least one fastening zone 120 and said at least one retention member 121 has a "U" or "C" shape in order to enable a better insertion 530 of said at least one tube 200, preferably of said at least one pipe 200.

Said at least one groove 220 is present on said at least one tube 200, preferably at least one pipe 200, in order to cooperate with said at least one fastening zone 120 of said fastening device 100, as previously mentioned. Thus, it is possible to admit 510 said at least one tube 200, preferably said at least one pipe 200, into said at least one admission zone 110 and to insert 530 said at least one tube 200, preferably said at least one pipe 200, into said at least one fastening zone 120, more precisely, to insert 530 said at least one groove 220, preferably being in the form of a recess 220, into said at least one fastening zone 120.

This insertion 530 of said at least one tube 200, preferably of said at least one pipe 200, may be promoted by the elastic deformation of said at least one fastening zone 120. Indeed, said at least one fastening zone 120 may deform or may be less elastically deformable than said at least one admission zone 110 and may fasten 540 said at least one tube 200, preferably said at least one pipe 200, to said at least one support 300 by exerting a force on said at least one tube 200, preferably said at least one pipe 200.

The fastening 540 of said at least one tube 200, preferably of said at least one pipe 200, to said at least one support 300 is thus performed and the electrical connection 550 of said at least one tube 200, preferably of said at least one pipe 200, to said at least one support 300 and the axial clearance between said at least one tube 200, preferably said at least one pipe 200, and said at least one support 300 is minimised and by ensuring a permanent electrical axial contact between said at least one tube 200, preferably said at least one pipe 200, and said at least one support 300.

Moreover, this electrical contact may be enabled by said at least one fastening zone 120 configured to pin said at least one tube 200, preferably said at least one pipe 200, to said at least one support 300, which on the one hand makes it possible to minimise the gap between said at least one tube 200, preferably said at least one pipe 200, and said at least one support 300 and, on the other hand, to promote an electrical contact between said at least one tube 200, preferably said at least one pipe 200, and said at least one support 300.

In order to secure 560 said at least one tube 200, preferably of said at least one pipe 200, to said at least one support 300, said fastening device 100 comprises at least one securing member 140 configured to secure said fastening device 100 to said at least one support 300, preferably to secure said fastening device 100 when said at least one fastening zone 120 fastens said at least one tube 200, preferably said at least one pipe 200, to said at least one support 300.

Said at least one securing member 140, visible in FIG. 1, may be in the form of a catch and protrude with said fastening device 100, preferably, said at least one securing member 140 protrudes in relation to the plane of said at least one admission zone 110 and/or of said at least one fastening zone 120 and may cooperate with a securing zone 340, able to be in the form of notch 340 included on said at least one support 300 and able to lock in radial position said fastening device 100. Indeed, given that said at least one admission zone 110 may deform or may be more elastically deformable than said at least one fastening zone 120, once said at least one tube 200, preferably of said at least one pipe 200, has been fastened in said at least one fastening zone 120, said at least one admission zone 110 elastically deforms in order to enable said at least one securing member 140 to cooperate with said securing zone 340.

According to one embodiment (not shown), said at least one securing member 140 may be coplanar with said at least one admission zone 110 and/or said at least one fastening zone 120.

Independently of the embodiments, said at least one securing member 140 makes it possible to secure said fastening device 100 to said at least one support 300 by limiting the movements of said fastening device 100 and to guarantee the fastening of said at least one tube 200, preferably of said at least one pipe 200, to said at least one support 300.

According to another aspect, said fastening device 100 may comprise at least one stabilising member 130 able to protrude with said fastening device 100 and/or able to delimit said at least one admission zone 110 and/or said at least one fastening zone 120. Preferably, said at least one stabilising member 130 makes the connection between said at least one admission zone 110 and said at least one fastening zone 120, and may enable the elastic deformation of said fastening device 100, and preferentially, makes it possible for said at least one admission zone 110 to deform more elastically than said at least one fastening zone 120 so that said at least one securing member 140 may cooperate with said securing zone 340.

Figure 4C:
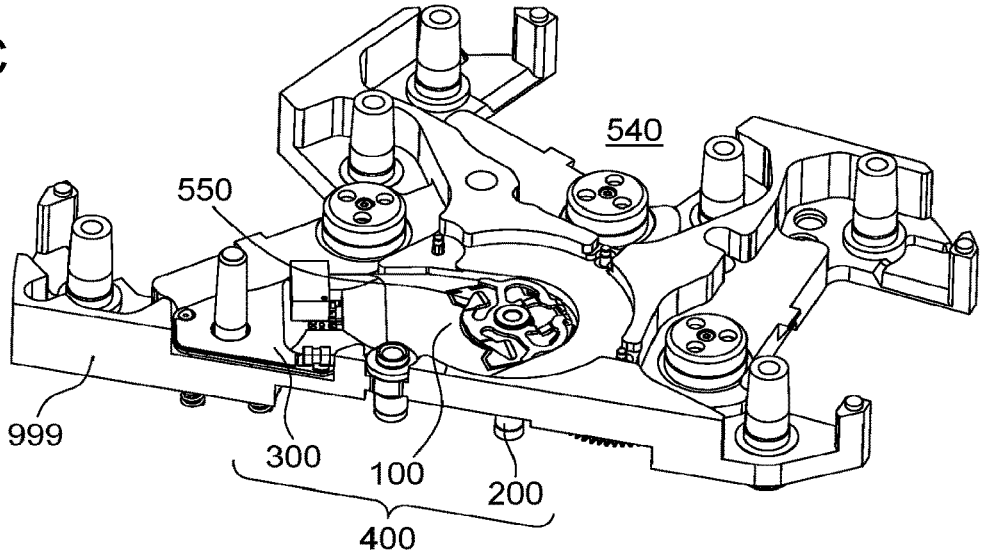

Said at least one stabilising member 130 may be in the form of a branch extending longitudinally, laterally and/or perpendicularly and is configured to stabilise said fastening device 100, preferably to stabilise said fastening device 100 when said at least one fastening zone 120 fastens said at least one tube 200, preferably said at least one pipe 200, to said at least one support 300. Indeed, said at least one stabilising member 130 may be at least one return member 130 and be curved towards said at least one support 300 so as to push said at least one tube 200, preferably said at least one pipe 200, via said fastening device 100 of said at least one support 300 in the manner of a spring. Said at least one bearing member 240, being disposed along said at least one tube 200, preferably said at least one pipe 200, and distant from said at least one groove 220, sandwiches said frame 999 and/or said at least one support 300 with said fastening device 100. The spring effect of said at least one stabilising member 130 creates a pinning force that guarantees the pinning of at least one tube 200, preferably of said at least one pipe 200, against said frame 999 and/or said at least one support 300 with said fastening device 100. This pinning may guarantee the perpendicularity of said at least one tube 200, preferably of said at least one pipe 200, which makes it possible to guarantee a correct operation of the wheels that will pivot on said at least one tube 200, preferably said at least one pipe 200, see FIG. 4C.

Moreover, according to one embodiment shown in FIG. 1, said at least one stabilising member 130 and said at least one securing member 140 may be combined and may be said at least one electrical conductor 101.

Thus thanks to the invention, said fastening device 100 has a greater vertical compliance and also thanks to its shape of ensuring an electrical contact. Moreover, said at least one support 300 includes a notch in order to orient said fastening device 100 in rotation about the tube and to lock said fastening device 100 in radial position. In this way the electrical contact is more or less covered by said fastening device 100, and the capacitive environment of the electrical contact remains repeatable once said fastening kit 400 has been mounted.

The invention claimed is:

1. A fastening device for fastening at least one tube and for electrically connecting said at least one tube to at least one support; said fastening device comprising at least:

one admission zone; said at least one admission zone being configured to admit said at least one tube;

one fastening zone that is coplanar with the at least one admission zone; said one at least one fastening zone having a U or C shape; said at least one fastening zone being configured to fasten said at least one tube to said at least one support;

one electrical conductor; said at least one electrical conductor being configured to electrically connect said at least one tube to said at least one support; and a securing member that secures the fastening device to said at least one support; said securing member being a lug projecting with respect to a plane of said at least one admission zone and of said at least one fastening zone; and said securing member being configured to cooperate with a securing zone of said at least one support to lock the fastening device in a radial position.

2. The fastening device according to claim 1, wherein said at least one fastening zone being configured to pin said at least one tube to said at least one support.

3. The fastening device according to claim 1, wherein said at least one fastening zone is elastically deformable or is less elastically deformable than said at least one admission zone.

4. The fastening device according to claim 1, further comprising at least one stabilising member configured to stabilise said fastening device when said at least one fastening zone fastens said at least one tube to said at least one support.

5. The fastening device according claim 4, wherein said at least one stabilising member and/or said at least one securing member is or are said at least one electrical conductor.

6. The fastening device according to claim 4, wherein said at least one stabilising member is elastically deformable to deform said at least one fastening zone and said at least one admission zone.

7. A fastening kit comprising at least:

a tube;

a support; and a fastening device for fastening said tube and for electrically connecting said tube to said support; said fastening device comprising at least:

an admission zone to admit said tube;

a fastening zone that is coplanar with said admission zone; said fastening zone having a U or C shape; said fastening zone being configured to fasten said tube to said support;

an electrical conductor configured to electrically connect said tube to said support; and a securing member that secures the fastening device to said support; said securing member being a lug projecting with respect to a plane of said admission zone and of said fastening zone; and said securing member being configured to cooperate with a securing zone of said support to lock the fastening device in a radial position.

8. The fastening kit according to claim 7, wherein said at least one tube comprises at least one bearing member including at least one collar configured to stabilise said at least one tube.

9. The fastening kit according to claim 7, wherein said fastening device includes a stabilising member configured to stabilise said fastening device when said fastening zone fastens said tube to said support.

10. The fastening kit according to claim 9, wherein said stabilising member is elastically deformable to deform said fastening zone and said admission zone.

11. A fastening method for fastening and for electrically connecting at least one tube to at least one support with at least one fastening device: said fastening device comprising at least:

one admission zone; said at least one admission zone being configured to admit said at least one tube;

one fastening zone that is coplanar with the at least one admission zone; said one at least one fastening zone having a U or C shape; said at least one fastening zone being configured to fasten said at least one tube to said at least one support;

one electrical conductor; said at least one electrical conductor being configured to electrically connect said at least one tube to said at least one support; and a securing member that secures the fastening device to said at least one support; said securing member being a lug projecting with respect to a plane of said at least one admission zone and of said at least one fastening zone; and said securing member being configured to cooperate with a securing zone of said at least one support to lock the fastening device in a radial position, said fastening method comprising:

admitting said at least one tube into said at least one admission zone of said at least one fastening device;

moving said at least one fastening device so that said at least one tube moves from said at least one admission zone to said at least one fastening zone;

inserting said at least one tube into said at least one fastening zone;

fastening said at least one tube to said at least one support such that said securing member cooperatues with the securing zone of said at least one support to lock the fastening device in a radial position; and, electrically connecting said at least one tube to said at least one support.

12. The fastening method according to claim 11, further comprising at least one securing step to said at least one support.

13. The fastening method according to claim 11, wherein said at least one step of admitting, moving, inserting, fastening and connecting are performed successively and/or simultaneously.

* * * * *